US008858269B2

(12) United States Patent
Brand et al.

(10) Patent No.: US 8,858,269 B2
(45) Date of Patent: Oct. 14, 2014

(54) TERMINAL BLOCK HAVING A BUS BAR WITH A METAL COLLAR WITH A CONTACT SURFACE WITH RIBS

(75) Inventors: Juergen Brand, Detmold (DE); Manuel Camino, Schieder-Schwalenberg (DE); Ralph Hoppmann, Bad Oeynhausen (DE); Holger Steinhage, Steinheim (DE)

(73) Assignee: Phoenix Contact GmbH & Co. KG (DE)

( * ) Notice: Subject to any disclaimer, the term of this patent is extended or adjusted under 35 U.S.C. 154(b) by 64 days.

(21) Appl. No.: 13/503,095

(22) PCT Filed: Feb. 12, 2010

(86) PCT No.: PCT/EP2010/000892

§ 371 (c)(1),
(2), (4) Date: Jul. 5, 2012

(87) PCT Pub. No.: WO2011/047740

PCT Pub. Date: Apr. 28, 2011

(65) Prior Publication Data

US 2012/0264339 A1 Oct. 18, 2012

(30) Foreign Application Priority Data

Oct. 22, 2009 (DE) ..... 10 2009 050 367

(51) Int. Cl.
*H01R 4/48* (2006.01)

(52) U.S. Cl.
USPC ..... 439/733.1

(58) Field of Classification Search
USPC ..... 439/733.1, 738–749
See application file for complete search history.

(56) References Cited

U.S. PATENT DOCUMENTS

| | | | | |
|---|---|---|---|---|
| 6,146,187 | A * | 11/2000 | Pallai | 439/441 |
| 6,280,233 | B1 * | 8/2001 | Beege et al. | 439/441 |
| 6,796,855 | B2 * | 9/2004 | Fricke et al. | 439/835 |
| 7,287,999 | B2 * | 10/2007 | Holterhoff et al. | 439/441 |
| 7,568,939 | B2 * | 8/2009 | Diekmann | 439/438 |
| 7,674,140 | B2 * | 3/2010 | Eppe et al. | 439/816 |
| 7,780,457 | B2 * | 8/2010 | Schafer et al. | 439/76.1 |
| 8,251,738 | B2 * | 8/2012 | Heckert et al. | 439/441 |

FOREIGN PATENT DOCUMENTS

| | | | |
|---|---|---|---|
| DE | 2440825 | A1 | 3/1976 |
| DE | 10-233243 | A | 9/1998 |
| EP | 1837887 | A1 | 9/2007 |
| EP | 1860735 | A1 | 11/2007 |

(Continued)

OTHER PUBLICATIONS

Kardinal, Ingrid, "PCT Application No. PCT/EP2010/000892 International Search Report Jul. 28, 2010", , Publisher: PCT, Published in: PCT.

(Continued)

*Primary Examiner* — Chandrika Prasad
(74) *Attorney, Agent, or Firm* — Kaplan Breyer Schwarz & Ottesen, LLP

(57) ABSTRACT

The invention relates to a spring-cage terminal block, having a bus bar and a leg spring for connecting a stripped conductor end piece of an electrical conductor, wherein the conductor end piece is inserted into a material passage of the bus bar and is clamped by means of the leg spring. According to the invention, the contact surface on the metal collar inner wall surface of the material passage has contact ribs extending along the insertion direction in order to form a linear contact pattern which extends in the insertion direction.

11 Claims, 7 Drawing Sheets

(56) References Cited

FOREIGN PATENT DOCUMENTS

| | | | |
|---|---|---|---|
| JP | 621157 | | 3/1994 |
| JP | 688058 | | 12/1994 |
| JP | 10-233243 | A | 9/1998 |
| JP | 2000182684 | | 6/2000 |
| JP | 2000182684 | A | 6/2000 |
| JP | 2004087500 | A | 3/2004 |
| JP | 2007087951 | A | 4/2007 |
| WO | 2008095453 | A1 | 8/2008 |

OTHER PUBLICATIONS

"Related Japanese Patent Application No. 2012-534553 Office Action", Nov. 26, 2013, Publisher: JPO, Published in: JP.

* cited by examiner

TERMINAL BLOCK HAVING A BUS BAR WITH A METAL COLLAR WITH A CONTACT SURFACE WITH RIBS

FIELD OF THE INVENTION

The invention relates to a spring-cage terminal block having a bus bar and a leg spring for connecting a stripped conductor end piece of an electrical conductor, having the category-defining features of claim 1.

BACKGROUND OF THE INVENTION

These types of spring-cage terminal blocks have an electrical conductor strip, usually referred to as a bus bar or current bar, which conducts the current. This bus bar has one or more openings for inserting one or more stripped conductor end pieces. For this purpose, the bus bar is typically made of a sheet metal strip, into which the openings in the form of material passages are punched. The stripped conductor end piece is typically inserted through a housing opening and into the opening in the bus bar formed by the material passage, and is clamped against the edge of the bus bar opening by means of a leg spring.

These types of spring-cage terminal blocks are used, for example, for the so-called direct plug-in or Direct Terminals for Installation (DTI) technology, whereby the configuration and contour of the leg spring allow the electrical conductors to be wired without tools. In a DTI terminal, the spring automatically opens when the conductor end piece is inserted, thus activating the leg spring. For this purpose, for example rigid single-wire conductors or pre-assembled stranded conductors having a wire end ferrule may be used.

EP 1 391 965 B1 describes an electric spring clamp terminal having a quadrilateral material passage which has an aperture collar and is used as a conductor plug-in opening. The inner wall surface of the aperture collar at that location forms a transverse edge which protrudes against the electrical conductor and extends transverse to the conductor plug-in direction, the transverse edge being formed in particular by the lower outer edge of the aperture collar of the material passage. The aim is to thus form a contact point as an intersection point between the electrical conductor and the protruding transverse edge at the inner wall surface of the aperture collar, thus minimizing the contact surface between the electrical conductor and the aperture collar of the material passage to a fairly small, defined contact surface in order to apply a maximum possible contact force. This improves the current conduction and contact security in the clamping site.

Within the scope of the present invention, however, it has been found that in such a terminal, the conductor may twist relatively easily in the clamping site due to the transverse extension of the transverse edge of the material passage, whereby the transverse edge cuts into the conductor end piece with each turning motion. The stability of the conductor end piece may thus be impaired, in particular for thin conductors.

These types of spring-cage terminal blocks typically may be used multiple times, so that the conductor may be plugged in and pulled back out multiple times. In particular, the conductor is moved during each insertion and removal operation, which is typically also accompanied by rotation. However, any other touching or moving of the conductor may also result in twisting, which is the case in particular in control cabinets, in which a large number of such terminals and associated conductors are present, so that any access to any of the spring-cage terminal blocks also frequently results in touching or moving a plurality of the other conductors.

The insertion force required to plug the conductor into the spring clamp terminal through a transverse edge may disadvantageously be increased. In addition, due to the punching process the transverse edge may have a certain roughness, as the result of which the insertion force may be increased even further, and the insertion operation may be rough and jerky. Accordingly, for such spring-cage terminal blocks a basically desired high clamping force is obtained at the cost of a basically undesired high insertion force. This may result in tilting of the conductor during insertion, in particular for thin conductors.

GENERAL DESCRIPTION OF THE INVENTION

The object of the invention, therefore, is to provide a spring-cage terminal block having a bus bar and a leg spring which provides the best possible balance between the contradictory goals of a high clamping force and a low insertion force.

A further object of the invention is to provide this type of spring-cage terminal block having a secure seating, in particular to protect against twisting of the conductor in the spring-cage terminal block.

A further object of the invention is to provide this type of spring-cage terminal block having lasting contact reliability, even when the conductor is inserted and removed multiple times.

The object of the invention is achieved by the subject matter of the independent claims. Advantageous refinements of the invention are defined in the subclaims.

The spring-cage terminal block according to the invention includes a bus bar and a leg spring, and is designed for connecting a stripped conductor end piece of an electrical conductor. The electrical spring-cage terminal block is designed as a plug-in terminal into which the stripped conductor end piece is inserted or pushed. These types of spring-cage terminal blocks are used, for example, in building installations or in control cabinets for current conduction, and have, for example, a connection capability from several tenths to several square millimeters at a maximum current in the range of up to several amperes or tens of amperes or more. The spring-cage terminal block may be constructed, for example, as a terminal using direct plug-in technology (so-called DTI terminal), so that the stripped conductor end piece may be inserted into the spring-cage terminal block without tools. The clamping element pair formed from the bus bar and leg spring is thus pushed on solely by the insertion force applied via the conductor in the insertion direction of the conductor. DTI terminals may be used, for example, for connecting rigid stripped (single) wires, or stranded conductors prefabricated with wire end ferrules.

The bus bar is made of a flat metal sheet, for example punched, and has one or more material passages. The material passage forms an insertion opening or an insertion aperture in the bus bar into which or through which the stripped conductor end piece is inserted or pushed through. The material passage is typically punched into the bus bar, and forms an annular metal collar which extends in the insertion direction, so that inner wall surfaces of the metal collar which extend in two dimensions are formed on the inner side of the metal collar facing the conductor insertion opening.

The leg spring has a clamping leg having a clamping site which is submerged in the material passage. The clamping site is preferably formed by the end-face end edge of the end of the clamping leg which extends transverse to the insertion direction. The bus bar, sometimes also referred to as a current bar, and the leg spring are installed in particular in a dielectric connection housing, for example a flat modular housing, and are fastened therein.

The leg spring is in particular designed as a leaf spring bent in a U shape, for example, and in particular has a retaining leg on the side of the clamping leg opposite from the U curve. The U curve provides pretensioning for clamping the conductor, the retaining leg being supported on the housing. When the stripped conductor end piece is inserted into the conductor insertion opening in the bus bar, the clamping leg is pushed against the pretensioning of the leg spring due to the applied insertion force, and the conductor end piece is inserted between the clamping site of the leg spring and one of the inner wall surfaces of the metal collar until the final clamped position is reached, in which the conductor end piece is fixedly clamped by the elastic force of the leg spring by means of the clamping leg. The clamping leg extends in the insertion direction, so that the clamp is self-closing. In other words, the conductor end piece which is inserted into the material passage, transverse to the bus bar, is clamped between the clamping site of the clamping leg and the first inner wall surface of the metal collar opposite from the clamping leg by means of the elastic force of the leg spring.

In contrast to the spring clamp terminal according to EP 1 391 965 B1 described in the introduction, in the present invention the point of contact is not formed by a narrow transverse edge extending transverse to the insertion direction, for example the outer edge of the aperture collar; instead, the first inner wall surface of the metal collar forms a contact surface which extends not transversely, but, rather, along the longitudinal axis of the clamped conductor end piece, i.e., extending in two dimensions, to establish the electrical current-conducting connection between the conductor and the bus bar. Thus, the spring-cage terminal block according to the invention is designed in such a way that in the clamped position, the stripped conductor end piece lies against the mentioned first inner wall surface of the metal collar over a certain extended length of the stripped conductor. To this end, the contact surface formed by the first inner wall surface of the metal collar in particular extends parallel to the insertion direction of the conductor.

Furthermore, according to the invention the contact surface has contact ribs, protruding in the direction of the clamping leg and extending parallel along the longitudinal axis of the clamped conductor end piece, such that in the clamped position, the stripped conductor end piece lies against the contact ribs over an extended length along its longitudinal axis, and is in electrical contact with the contact ribs, so that in particular a contact area extending in two dimensions results in such a way that the contact area extending in two dimensions is formed between the contact surface of the bus bar and the conductor end piece of at least two contact lines running adjacent to one another. Accordingly, a linear contact pattern which extends in the insertion direction is formed from one of multiple adjacently situated lines which extend along the conductor.

The required insertion force for introducing the conductor end piece into the clamp between the leg spring and the contact surface of bus bar is kept relatively low by the fact that the contact ribs which form the contact lines extend in the direction of the conductor, i.e., the conductor insertion direction. The contact ribs also act as a guide while inserting the conductor end piece. On the other hand, a sufficient contact force or surface pressure may be achieved at the point of contact. Thus, by means of the invention, these two basically contradictory requirements may advantageously be met at the same time.

However, the invention has further advantages. Twisting of the conductor in the clamped position is counteracted due to the longitudinal extension of the contact ribs. The annular cutting into the conductor may thus be prevented or at least reduced. Nevertheless, the conductor end piece is held with a high retaining force by the clamping edge of the clamping leg, thus preventing the conductor end piece from being pulled out of the terminal. Namely, the two clamping elements on both sides of the clamp (clamping edge of the clamping leg and contact surface of the bus bar) extend at right angles to one another, thus producing strong frictional locking in various force directions.

The clamping site of the clamping leg in the direction of the longitudinal axis of the conductor end piece is advantageously positioned in the middle or in the vicinity of the middle of the contact surface of the bus bar or of the first inner wall surface of the metal collar when the conductor end piece is clamped in the clamped position. This ensures a uniform contact force or normal force over the extension of the contact surface and along the conductor end piece, and ensures secure flat contact.

The contact ribs preferably have a triangular cross section transverse to the longitudinal axis of the conductor, so that the upper edges of the contact ribs facing the conductor end piece are able to penetrate in a defined manner into the conductor, for example, which is typically made of copper or a copper alloy. In particular, the contact surface transverse to the longitudinal axis of the clamped conductor end piece has a zigzag cross section, in which a groove, for example having a likewise triangular cross section, is provided between every two contact ribs, so that the contact between the conductor end piece and the contact surface is formed along multiple lines along the longitudinal axis of the clamped conductor end piece.

According to one embodiment of the invention, the contact surface is flat, and the contact ribs extend linearly along the longitudinal axis of the clamped conductor end piece. In the clamped position the conductor end piece extends parallel to the plane of the contact surface. A long contact length along the longitudinal axis of the clamped conductor end piece is thus achieved.

Alternatively, the contact surface along the longitudinal axis of the clamped conductor end piece may have a convex curvature in the direction of the clamping leg or the conductor end piece. In this embodiment, the radius of curvature is preferably large enough, and the edges of the contact ribs are sufficiently sharp, that the contact ribs along the longitudinal axis of the clamped conductor end piece penetrate slightly into the conductor end piece over an extended length along its longitudinal axis. Depending on the application, however, it may be desired to shorten the contact length of the conductor end piece by means of the curvature. It may also be advantageous for the contact surface to have a crowned (two-dimensionally convex) or saddle-shaped design.

Tests have shown that the grid spacing between the contact ribs is approximately in the range between one-third and one-twentieth of the maximum diameter of the electrical conductor for which the spring-cage terminal block is dimensioned. The number of contact ribs may preferably be in the range between approximately 5 and approximately 50. On the one hand this ensures a sufficient contact force, and on the other hand ensures sufficient frictional locking against twisting of the conductor. However, it is not ruled out that at least two or three contact ribs are provided, if needed.

According to one embodiment of the invention, the dielectric connection housing has a conductor insertion funnel which specifies the insertion direction of the conductor during insertion and supports the conductor against roughly tilting in the clamped position. The correct contact of the conductor end piece against the contact surface may be assisted in this manner. The insertion channel in particular extends parallel to the contact surface.

Furthermore, the dielectric connection housing preferably forms a closed pocket on the side of the material passage opposite from the insertion side, in which the conductor end piece submerges on the other side of the clamp. The pocket has a base which forms a stop for the end-face end of the conductor end piece during insertion.

The invention is explained in greater detail below based on exemplary embodiments and with reference to the figures; identical and similar elements are sometimes provided with the same reference numerals, and the features of the various exemplary embodiments may be combined with one another.

DETAILED DESCRIPTION OF THE INVENTION

Figure 1:
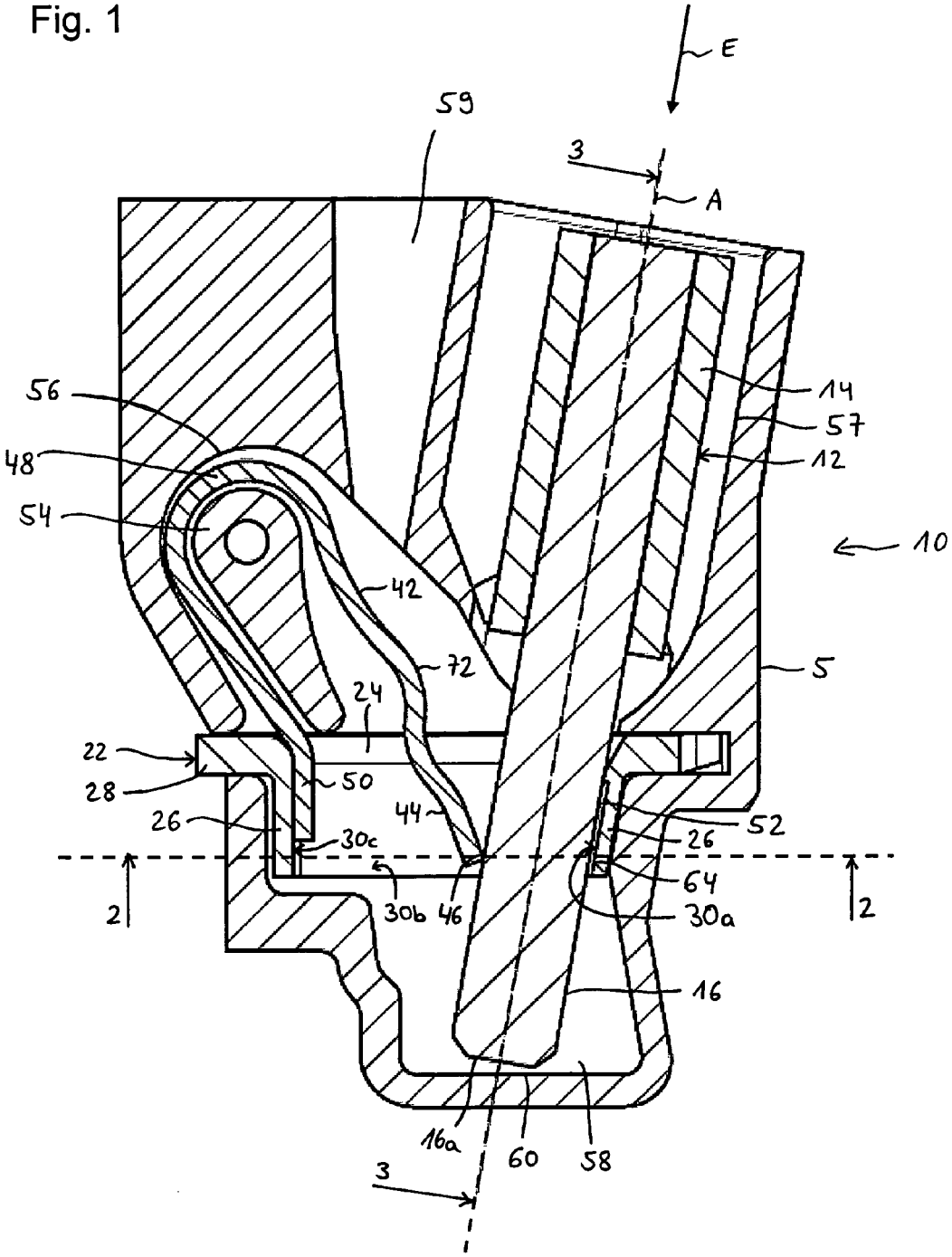
FIG. 1 shows a cross-sectional illustration of the spring-cage terminal block, with an inserted conductor end piece in the clamped position.

With reference to FIG. 1, the conductor 12 having cable sheathing 14, and a conductor end piece 16 from which the cable sheathing 14 has been stripped, in the spring-cage terminal block 10 are illustrated. The spring-cage terminal block 10 has a bus bar 22 extending perpendicular to the plane of the drawing. The bus bar 22 has a material passage 24 having a circumferential metal collar 26. The material passage 24 together with the metal collar 26 is typically punched out from a metal sheet from which the bus bar 22 is produced in one piece. In the present example the metal collar 26 is annularly closed, has an essentially rectangular design, and on the whole extends from the flat bus bar strip 28 in the insertion direction E (from top to bottom in FIG. 1). The rectangular circumferential metal collar 26 has peripheral inner wall surfaces 30*a* through 30*d* of the metal collar, from which the inner wall surfaces 30*a* and 30*c* of the metal collar extend perpendicular to the plane of the drawing.

The inner wall surface 30*a* of the metal collar is situated opposite from the leg spring 42, and forms the contact surface 52 of the bus bar 22 for the stripped electrical conductor end piece 16.

The leg spring 42 has a clamping leg 44 with a lower clamping leg end which forms the clamping site 46 against the conductor end piece 16. The leg spring 42, designed as a leaf spring bent essentially in a U shape, also has a spring bend region 48 and a retaining leg 50. The leg spring 42 is fixed in place by a retaining eye 54 in the dielectric connection housing or terminal housing 5 in the region of the spring bend 48, and by an arc-shaped enclosure 56 in the plastic connection housing 5. The retaining leg 50 is submerged in the material passage 24, and is supported on the metal collar 26, i.e., the inner wall surface 30*c* of the metal collar. The leg spring 42 clamps with its clamping leg; more precisely, with the end of the clamping leg 44 which forms the clamping site 46 the leg spring clamps the stripped conductor end piece 16 against the contact surface 52. For this purpose, the clamping leg 44 is submerged in the material passage 24, specifically, toward the insertion direction E (from the top in FIG. 1). Accordingly, the clamping leg 44 extends in the same direction as the metal collar 26 of the bus bar 22.

The electrical connection housing 5 also has a closed pocket 58 beneath the metal collar 26 which accommodates, i.e., surrounds, the end-face end 16*a* of the stripped conductor end piece 16. The base 60 of the pocket 58 forms a stop for the conductor end piece 16 when the conductor 12 is inserted.

As is apparent in FIG. 1, the conductor end piece 16 extends parallel to the contact surface 52, and in the present example lies against the contact surface 52, which in the present example is flat, over a majority of the extension of the metal collar 26 along the longitudinal axis A of the conductor 12 in order to contact this contact surface. The contact surface 52 has a ribbed surface 64 provided with contact ribs 62, as illustrated most clearly in FIGS. 2 through 6.

The connection housing 5 also has a conductor insertion funnel 57 which guides the conductor 12 during insertion and in the clamped position, and which essentially specifies the insertion direction E. For this purpose, the conductor insertion funnel 57 extends essentially parallel to the contact surface 52. In the present example, the insertion direction E, i.e., the axis A of the conductor 12 as well as the contact surface 52, extend at an oblique angle with respect to the bus bar strip 28.

The clamping leg 44 has a protrusion 72 facing the conductor 12. To release the conductor from the spring-cage terminal block 10, a tool such as a screwdriver is inserted through the tool opening 59 in the connection housing 5, and the terminal is opened with the tool, the protrusion 72 assisting in bending the leg spring 42.

Figure 2:
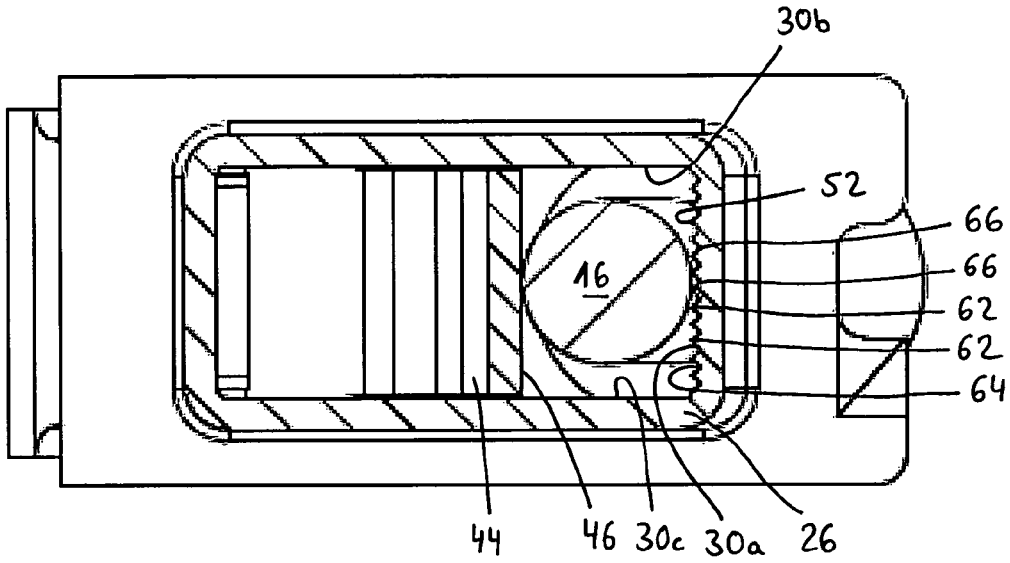
FIG. 2 shows a partial cross-sectional illustration along line 2-2 in FIG. 1.

With reference to FIG. 2, the contact ribs 62 have an essentially triangular cross section and extend along the axis A of the conductor 12. The contact ribs 62 together with the likewise essentially triangular grooves 66 situated therebetween form the one-dimensionally ribbed surface 64, which accordingly has a uniform zigzag-shaped cross section transverse to the axis A of the conductor 12. As illustrated in FIG. 2, in the clamped position the conductor end piece 16 typically lies linearly against at least two of the contact ribs 62. Depending on the pressure force of the leg spring 42, the softness of the conductor material, and the size and sharpness of the contact ribs 62, the contact ribs 62 become more or less embedded in the conductor end piece 16, so that contact at more than two of the contact ribs 62 is also possible. A contact region having multiple contact lines extending adjacently between the conductor end piece 16 and the contact surface 52 is thus formed.

Figure 3:
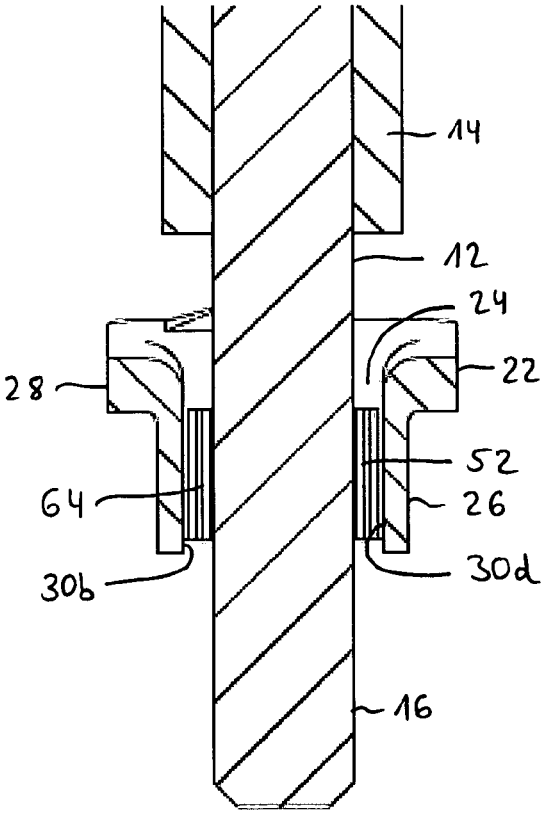
FIG. 3 shows a partial cross-sectional illustration along line 3-3 in FIG. 1.

With reference to FIG. 3, the contact ribs 62 extend over the metal collar 26, i.e., the inner wall surface 30*a* of the metal collar, over a significant portion of the length along the axis A of the conductor 12.

Figure 4:
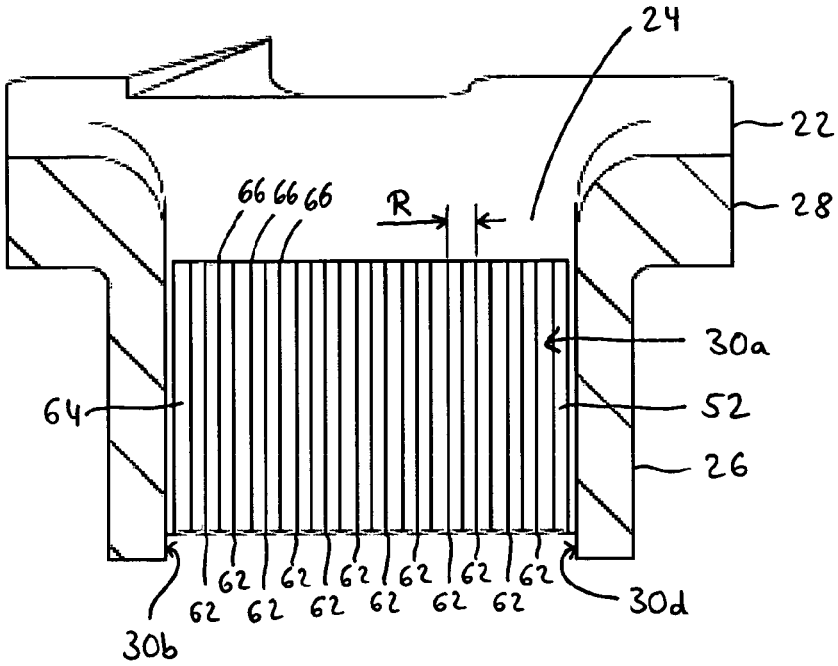
FIG. 4 shows a partial perspective cross-sectional illustration along line 3-3 in FIG. 1, without a conductor.

The dimensioning of the contact ribs 62 and of the grooves 66 is most easily discerned in FIG. 4. In the example in FIG. 4, the ribbed surface 64 of the contact surface 52 has twelve contact ribs 62, which are formed by impressing the grooves 66 situated in-between on the inner wall surface 30*a* of the metal collar.

Figure 5:
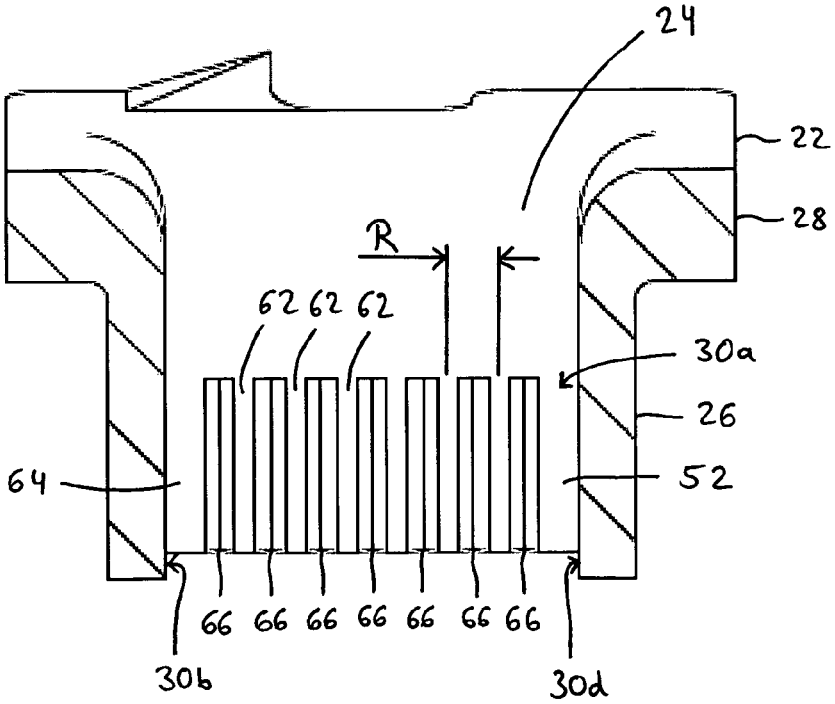
FIG. 5 shows a partial perspective cross-sectional illustration corresponding to FIG. 4 in another embodiment of the invention.

FIG. 5 shows an alternative embodiment having six contact ribs 62 which are slightly shorter than those in FIG. 4. In addition, the spacing of the grooves 66 between the contact ribs 62 is greater than in FIG. 4, so that the grid spacing R of the contact ribs 62 is greater than in the embodiment in FIG. 4.

Figure 6:
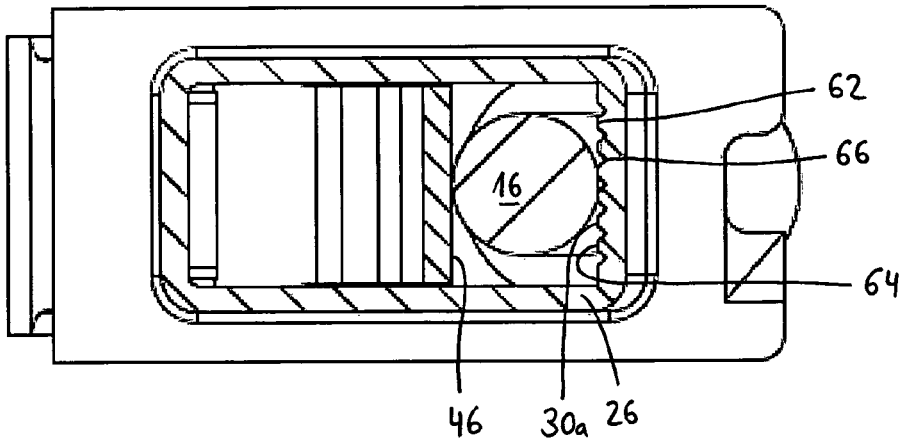
FIG. 6 shows a partial cross-sectional illustration, similar to FIG. 2, of the embodiment from FIG. 5.

With reference to FIG. 6, the contact ribs 62 have a trapezoidal cross section.

Figure 7:
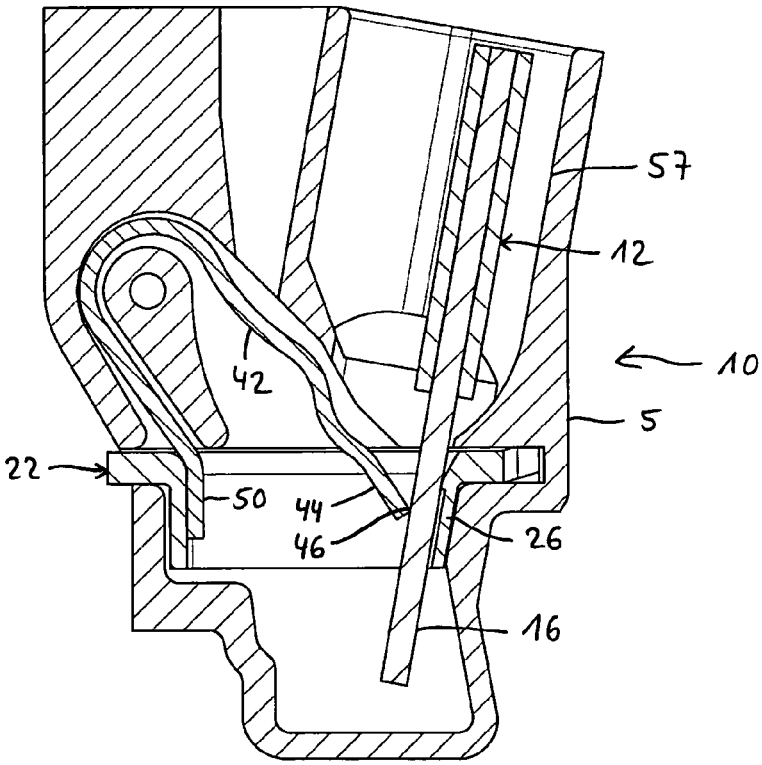
FIG. 7 shows a cross-sectional illustration as in FIG. 1, with a thinner conductor.

As is apparent from a comparison of FIGS. 1 and 7, in the spring-cage terminal block 10 the vertical position of the clamping site 46 depends on the thickness of the electrical conductor on account of the swivel motion of the clamping leg 44. For a smaller diameter of the electrical conductor (FIG. 7), the clamping site 46 is situated higher than for a larger diameter (FIG. 1). The spring-cage terminal block 10 is designed and permitted for a certain interval of conductor diameters, for example for conductor diameters in the range of 0.5 mm to 4 mm. In this regard, the clamping site 46, at least for conductor diameters less than the maximum permitted conductor diameter, is located above the bottom edge 52*a* of the contact surface 52.

Figure 8:
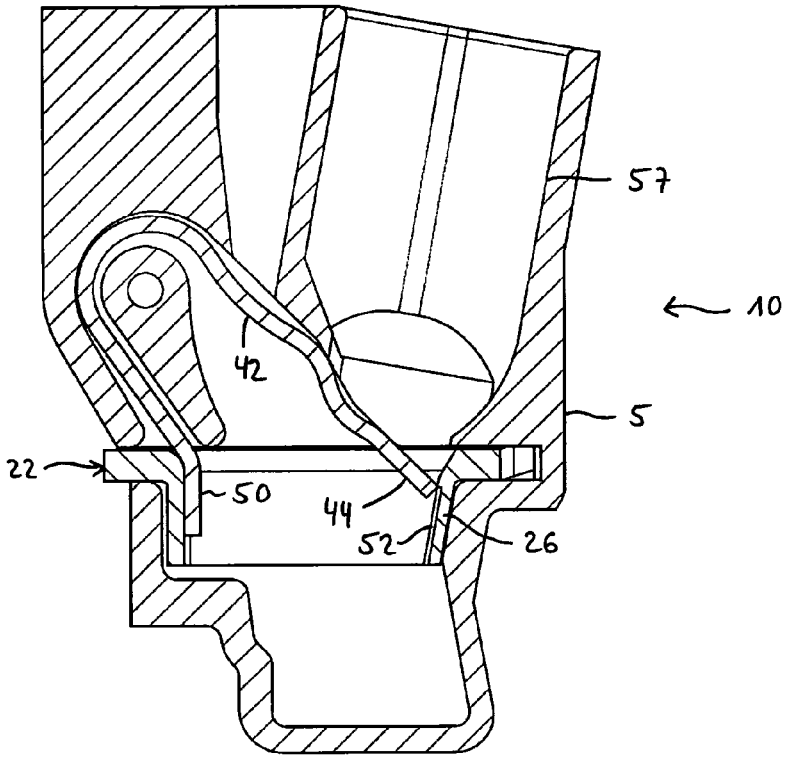
FIG. 8 shows a cross-sectional illustration as in FIG. 1, without a conductor.

FIG. 8 shows the spring-cage terminal block 10 from FIGS. 1 and 7 before the conductor is inserted, the clamping leg 44 lying against the contact surface 52 due to the pretensioning of the leg spring 42.

Although the conductor 12 is guided fairly well through the conductor insertion funnel 57, there is still some play, in particular for thin conductors, so that to a limited degree the conductor 12 may be subject to tilting. In the embodiment of the invention illustrated in FIGS. 1, 7, and 8, if there is tilting of the conductor, the conductor end piece may thus briefly be in contact primarily with the bottom edge 52*a* of the contact surface 52, even though this is basically undesired.

Figure 9:
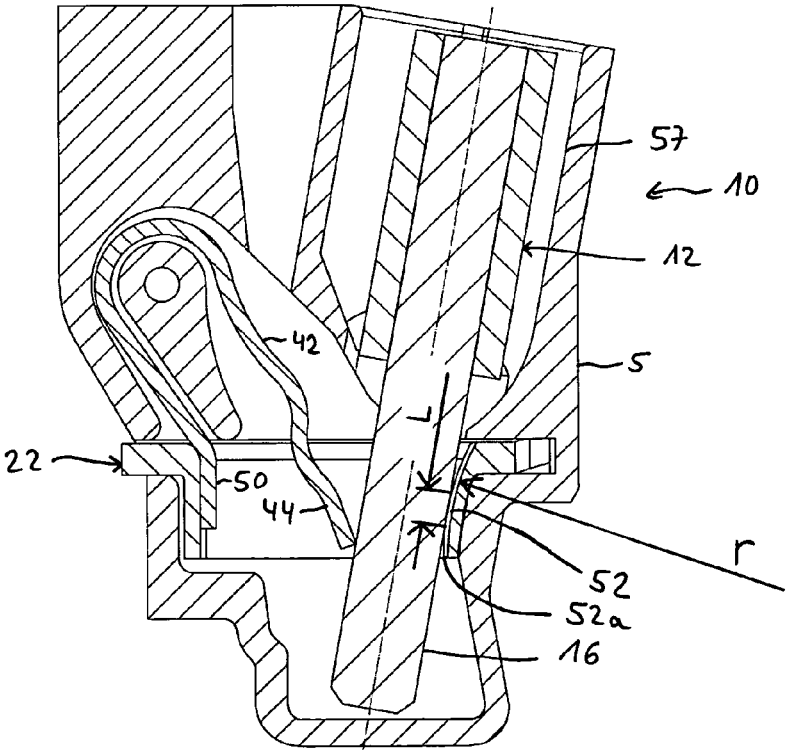
FIG. 9 shows a cross-sectional illustration of the spring-cage terminal block according to another embodiment, with the inserted conductor end piece in the clamped position.

FIG. 9 shows a spring-cage terminal block 10 according to a modified embodiment of the invention, namely, having a contact surface 52 with a convex curvature along the longitudinal axis A. The radius of curvature r of the contact surface 52 is dimensioned to be large enough that, due to the softness of the conductor (typically copper or a copper alloy), the conductor end piece 16 is in electrical contact with the contact surface 52 on a finite length L along the longitudinal axis A. The length L should be at least several tenths of a millimeter, preferably one millimeter or greater. The curvature of the contact surface 52 has the advantage that if the conductor 12 nevertheless tilts slightly, a large-surface electrical contact between the conductor end piece 16 and the contact surface 52 is maintained, and specifically, the conductor end piece is not damaged by the bottom edge 52*a*. The contact surface 52 may be curved in one dimension, or also in two dimensions. The two-dimensional curvature may be either crowned, i.e., having a convex shape in both dimensions of the plane of the contact surface 52, or saddle-shaped, i.e., having a convex shape along the longitudinal axis A and having a concave shape transverse to the longitudinal axis A.

Lastly, the size of the surface at which the conductor end piece 16 lies against the contact surface 52 may be further enlarged.

Figure 10:
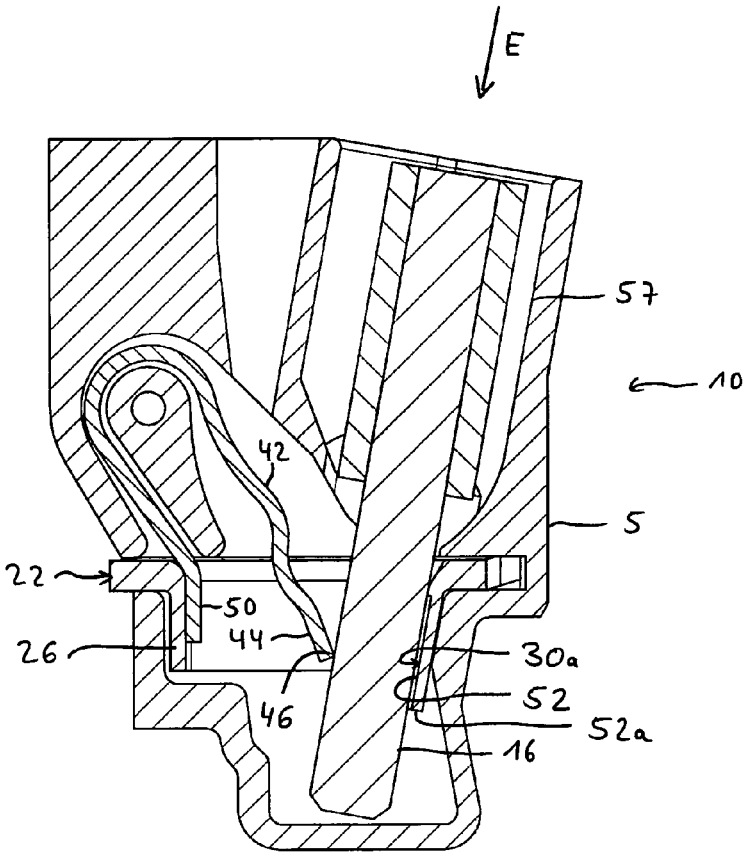
FIG. 10 shows a cross-sectional illustration of the spring-cage terminal block according to another embodiment, with the inserted conductor end piece in the clamped position.
Figure 11:
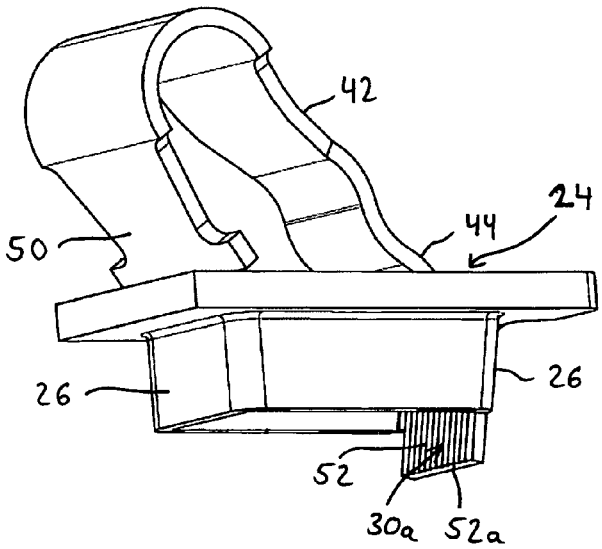
FIG. 11 shows a three-dimensional illustration of the material passage in the embodiment from FIG. 10.

FIG. 10 shows a spring-cage terminal block 10 according to another modified embodiment of the invention, namely, having an elongated contact surface 52. In this regard, the inner wall surface 30*a* of the metal collar opposite from the leg spring 42 is elongated downwardly. The inner wall surface 30*a* of the metal collar, i.e., the contact surface 52, thus protrudes in the insertion direction E over the remainder of the metal collar 26. Tilting of the conductor end piece 16 is thus advantageously counteracted, and it is ensured that the conductor end piece 16 lies against the contact surface 52 over a long length L. Cutting into the conductor end piece 16 by the bottom edge 52*a* is thus largely avoided, and the contact surface is enlarged. In this embodiment, the clamping site 46 is still situated above the bottom edge 52*a* of the contact surface 52, even for the maximum permitted conductor diameter. FIG. 11 shows a section of the associated bus bar 22 together with the material passage 24 and the leg spring 42 in a three-dimensional illustration.

Figure 12:
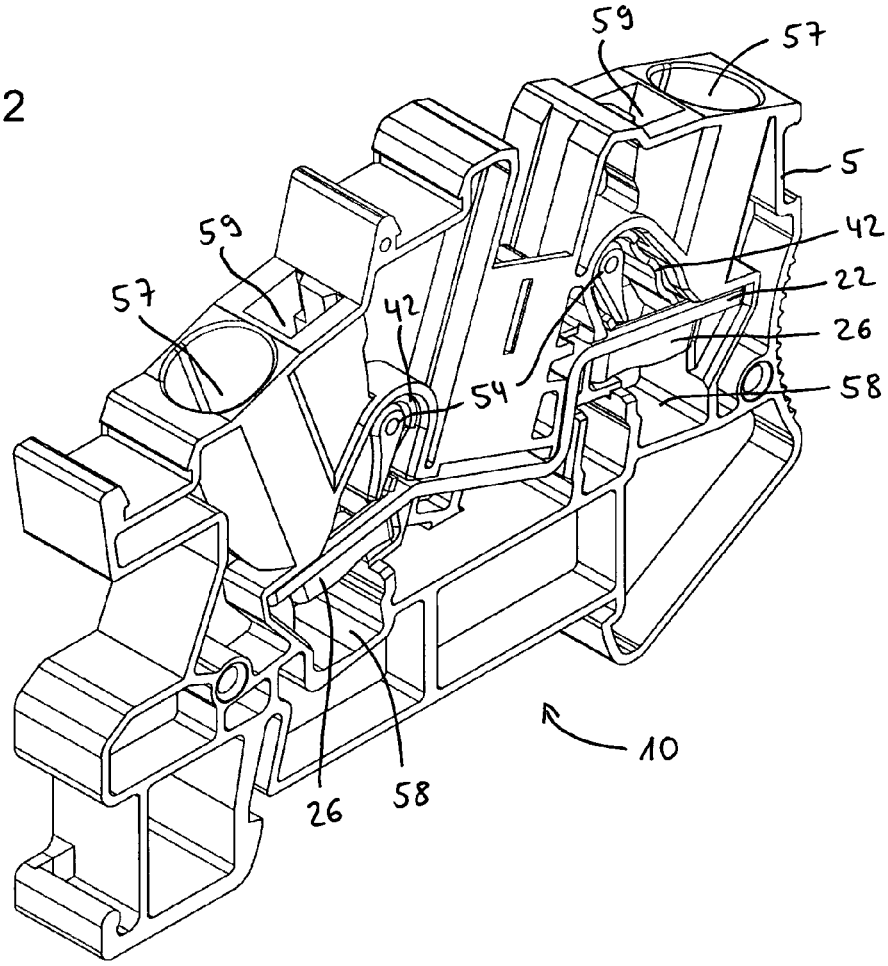
FIG. 12 shows a three-dimensional illustration of a spring-cage terminal block module having two clamping sites.

FIG. 12 shows a spring-cage terminal block 10 for modular attachment onto a mounting rail (not illustrated). As is known to those skilled in the art, a plurality of these modules 10 is placed one next to the other on the mounting rail, for example in building installation technology.

Figure 13:
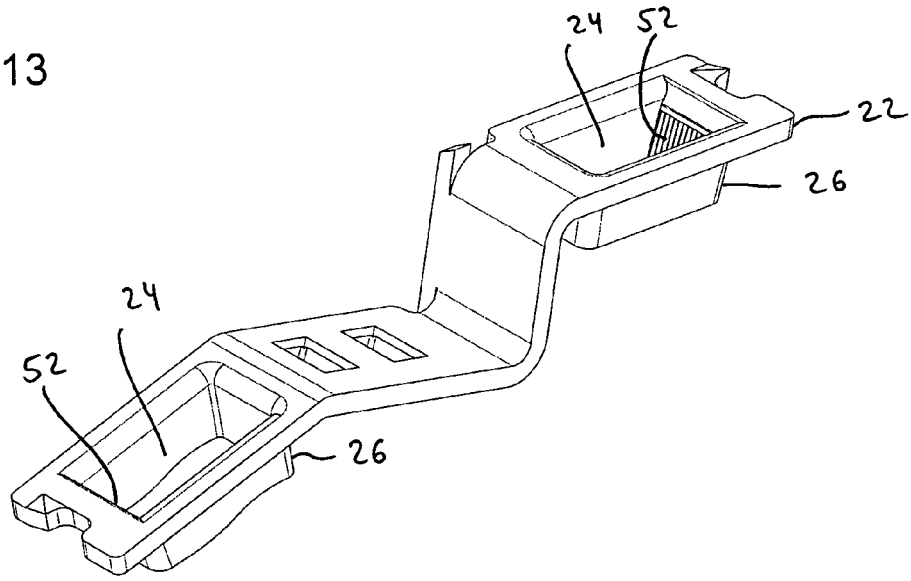
FIG. 13 shows a three-dimensional illustration of the bus bar from FIG. 12.

FIG. 13 shows the bus bar 22 of the spring-cage terminal block 10 from FIG. 12 in a bent shape, and having two vertically offset material passages 24.

It is apparent to those skilled in the art that the above-described embodiments are to be understood as examples, and that the invention is not limited to same, but, rather, may be varied in numerous ways without departing from the invention. Furthermore, it is apparent that the features, regardless of whether they are disclosed in the description, the claims, the figures, or in some other way, also define important parts of the invention when taken alone, even if they are described jointly with other features.

The invention claimed is:

1. A spring-cage terminal block (10) comprising:

a bus bar (22) and a leg spring (42) for connecting a stripped conductor end piece (16) of an electrical conductor (12), wherein the bus bar (22) is made of a flat metal sheet and has at least one material passage (24) which forms an insertion opening for the stripped conductor end piece (16), wherein the material passage (24) has an annular metal collar (26) which extends in the insertion direction, and which has inner wall surfaces (30*a*-30*d*) of the metal collar at its inner side facing the insertion opening, wherein the leg spring (42) has a clamping leg (44) having a clamping site (46) which submerges in the material passage (24), wherein the conductor end piece (16) which is inserted into the material passage (24), transverse to the bus bar (22), is clamped between the clamping site (46) of the clamping leg (44) and the oppositely situated inner wall surface (30*a*) of the metal collar by means of the elastic force of the leg spring (42), wherein the inner wall surface (30*a*) of the metal collar opposite from the clamping site (46) of the clamping leg (44) forms a contact surface (52) for the conductor end piece (16) which extends along the longitudinal axis (A) of the clamped conductor end piece (16), and wherein the contact surface (52) has contact ribs (62) which protrude in the direction of the clamping leg (44)

and extend along the longitudinal axis (A) of the clamped conductor end piece (16), such that in the clamped position, the stripped conductor end piece (16) lies against the contact ribs (62) over an extended length along its longitudinal axis (A), and is in electrical contact with the contact ribs.

2. The spring-cage terminal block (10) according to claim 1, wherein the clamping site (46) of the clamping leg (44) in the direction of the longitudinal axis (A) of the conductor end piece (16) is positioned in the middle or in the vicinity of the middle of the contact surface (52) when the conductor end piece (16) is clamped in the clamped position.

3. The spring-cage terminal block (10) according to claim 1, wherein the contact ribs (62) have a triangular, trapezoidal, rectangular, or wave-like cross section.

4. The spring-cage terminal block (10) according to claim 3, wherein a groove (66) is provided between every two contact ribs (62), so that the contact surface transverse to the longitudinal axis (A) of the clamped conductor end piece (16) has a zigzag-shaped surface (64).

5. The spring-cage terminal block (10) according to claim 1, wherein the contact ribs (62) extend linearly along the longitudinal axis (A) of the clamped conductor end piece (16).

6. The spring-cage terminal block (10) according to claim 1, wherein the contact surface (52) along the longitudinal axis (A) of the clamped conductor end piece (16) has a convex curvature in the direction of the clamping leg (44).

7. The spring-cape terminal block (10) according to claim 6, wherein a radius of curvature has a dimension r which provides electrical contact with the contact surface (52) on a length L along the longitudal axis (A), wherein said length L is at least one millimeter, and the contact ribs (62) penetrate into the conductor end piece (16) of the clamped conductor end piece over an extended length along the longitudinal axis (A).

8. The spring-cage terminal block (10) according to claim 1, wherein a grid spacing (R) between the contact ribs (62) is between one-third and one-twentieth of the diameter of the electrical conductor for which the spring-cage terminal block (10) is dimensioned.

9. The spring-cage terminal block (10) according to claim 1, wherein the spring-cage terminal block (10) includes a dielectric connection housing (5) in which the bus bar (22) and the leg spring (42) are fastened, the dielectric connection housing (5) having a conductor insertion funnel (57) which specifies the insertion direction (E) of the conductor (12) and supports the conductor (12) against roughly tilting in the clamped position.

10. The spring-cage terminal block (10) according to claim 9, wherein the dielectric connection housing (5) forms a closed pocket (58) on the side of the material passage (24) opposite from the insertion side, in which the end-face end (16*a*) of the conductor end piece (16) submerges in the clamped position.

11. The spring-cage terminal block (10) according to claim 1, wherein the inner wall surface (30*a*) of the metal collar opposite from the clamping leg (44) protrudes beyond the metal collar (26) in the insertion direction (E).

* * * * *